US010969809B2

(12) United States Patent
Deval

(10) Patent No.: US 10,969,809 B2
(45) Date of Patent: Apr. 6, 2021

(54) DUAL INPUT LDO VOLTAGE REGULATOR

(71) Applicant: Microchip Technology Incorporated, Chandler, AZ (US)

(72) Inventor: Philippe Deval, Lutry (CH)

(73) Assignee: Microchip Technology Incorporated, Chandler, AZ (US)

( * ) Notice: Subject to any disclaimer, the term of this patent is extended or adjusted under 35 U.S.C. 154(b) by 0 days.

(21) Appl. No.: 16/527,488

(22) Filed: Jul. 31, 2019

(65) Prior Publication Data

US 2020/0042028 A1 Feb. 6, 2020

Related U.S. Application Data

(60) Provisional application No. 62/713,634, filed on Aug. 2, 2018.

(51) Int. Cl.
*G05F 1/56* (2006.01)

(52) U.S. Cl.
CPC ..... *G05F 1/56* (2013.01)

(58) Field of Classification Search
CPC ..... G05F 1/56
See application file for complete search history.

(56) References Cited

U.S. PATENT DOCUMENTS

2008/0084195 A1 4/2008 Frew et al. ..... 323/282
2012/0292999 A1* 11/2012 Henkel ..... H02J 1/102 307/52
2017/0346284 A1 11/2017 Lee et al.

FOREIGN PATENT DOCUMENTS

DE 19722127 C1 7/1998 ..... G05F 1/575
EP 2747284 A1 6/2014 ..... H03K 17/06

OTHER PUBLICATIONS

International Search Report and Written Opinion, Application No. PCT/US2019/044585, 15 pages, dated Sep. 17, 2019.

* cited by examiner

*Primary Examiner* — Robert L Deberadinis
(74) *Attorney, Agent, or Firm* — Slayden Grubert Beard PLLC

(57) ABSTRACT

A low dropout (LDO) includes voltage inputs to receive input from voltage sources. The LDO voltage regulator includes a regulated voltage output, blocking diodes, and circuitry configured to block leakage from a first voltage input with a first blocking diode when the first voltage input is less than the regulated voltage output, and to provide the regulated voltage output from the first voltage input and a second voltage input.

21 Claims, 6 Drawing Sheets

DUAL INPUT LDO VOLTAGE REGULATOR

PRIORITY

The present application priority to U.S. Provisional Patent Application No. 62/713,634 filed Aug. 2, 2018, the contents of which are hereby incorporated in their entirety.

FIELD OF THE INVENTION

The present disclosure relates to power regulation and, more particularly, to a dual input low dropout (LDO) voltage regulator circuit and method for providing a regulated supply voltage from two independent supply ports.

BACKGROUND

An LDO voltage regulator may include a direct current (DC) voltage regulator that can regulate output voltage even when the supply voltage is very close to the output voltage.

LDO voltage regulators may be used to avoid switching. LDO voltage regulators dissipate power in order to regulate the output voltage. LDO voltage regulators may be implemented with a power field-effect transistor (FET). Moreover, LDO voltage regulators may be implemented with a differential amplifier to amplify the error. An input of the differential amplifier may monitor a fraction of the output determined by a resistor ratio. An LDO voltage regulator may include an input from a known, stable voltage reference. LDO voltage regulators may operate by driving their transistors to saturation. The voltage drop from an unregulated supply voltage to the regulated voltage can be as low as the saturation voltage across the transistor. Power FETs or bipolar transistors may be used in the LDO voltage regulator.

One characteristic of an LDO voltage regulator is its quiescent current. This current may account for the difference between the input current and the output current of the LDO voltage regulator. This current difference may be drawn by the LDO voltage regulator in order to control its internal circuitry for proper operation. The transient response of an LDO voltage regulator is the maximum allowable output voltage variation for a step change in load current. The response may be a function of output capacitance, equivalent series resistance of such capacitance, the bypass capacitor, and maximum load-current. Applications of LDO voltage regulators may include, for example, voltage, current and temperature monitoring, and diagnostic information gathering. LDO voltage regulators may be controlled with programmable current limits, active output discharges, or control of power supplies related to the LDO voltage regulator.

Inventors of embodiments of the present disclosure have discovered solutions for providing bi-directional, high-voltage power switches that are self-supplied from the switch ports therein. Such power switches may include the UC 53205 power switch, available from Microchip Technology, Inc., the assignee of the present disclosure. As a result, inventors of embodiments of the present disclosure have discovered that a need exists for an internal regulator within such a power switch that is able to provide the regulated voltage independently from its ports while not leaking current from the regulated voltage output back to a voltage source in a port whose voltage is lower than the regulated voltage output. Embodiments of the present disclosure may address one or more of these needs.

SUMMARY

Embodiments of the present disclosure may include an LDO voltage regulator. The LDO voltage regulator may include voltage inputs to receive input from voltage sources. The LDO voltage regulator may include a regulated voltage output, blocking diodes, and circuitry configured to block leakage from a first voltage input with a first blocking diode when the first voltage input is less than the regulated voltage output, and to provide the regulated voltage output from the first voltage input and a second voltage input.

Embodiments of the present disclosure may include a microcontroller. The microcontroller may include voltage sources and an LDO voltage regulator. The LDO voltage regulator may include voltage inputs to receive input from the voltage sources. The LDO voltage regulator may include a regulated voltage output, blocking diodes, and circuitry configured to block leakage from a first voltage input with a first blocking diode when the first voltage input is less than the regulated voltage output, and to provide the regulated voltage output from the first voltage input and a second voltage input.

Embodiments of the present disclosure may include a method. The method may be performed by an LDO voltage regulator. The method may include, at a first voltage input, receiving input from a first voltage source. The method may further include, at a second voltage input, receiving input from a second voltage source. The method may further include blocking leakage to the first voltage input from a regulated voltage output of the LDO regulator with the first blocking diode when the first voltage input is less than the regulated voltage output, and providing the regulated voltage output from the first voltage input and the second voltage input.

DETAILED DESCRIPTION

Figure 1:
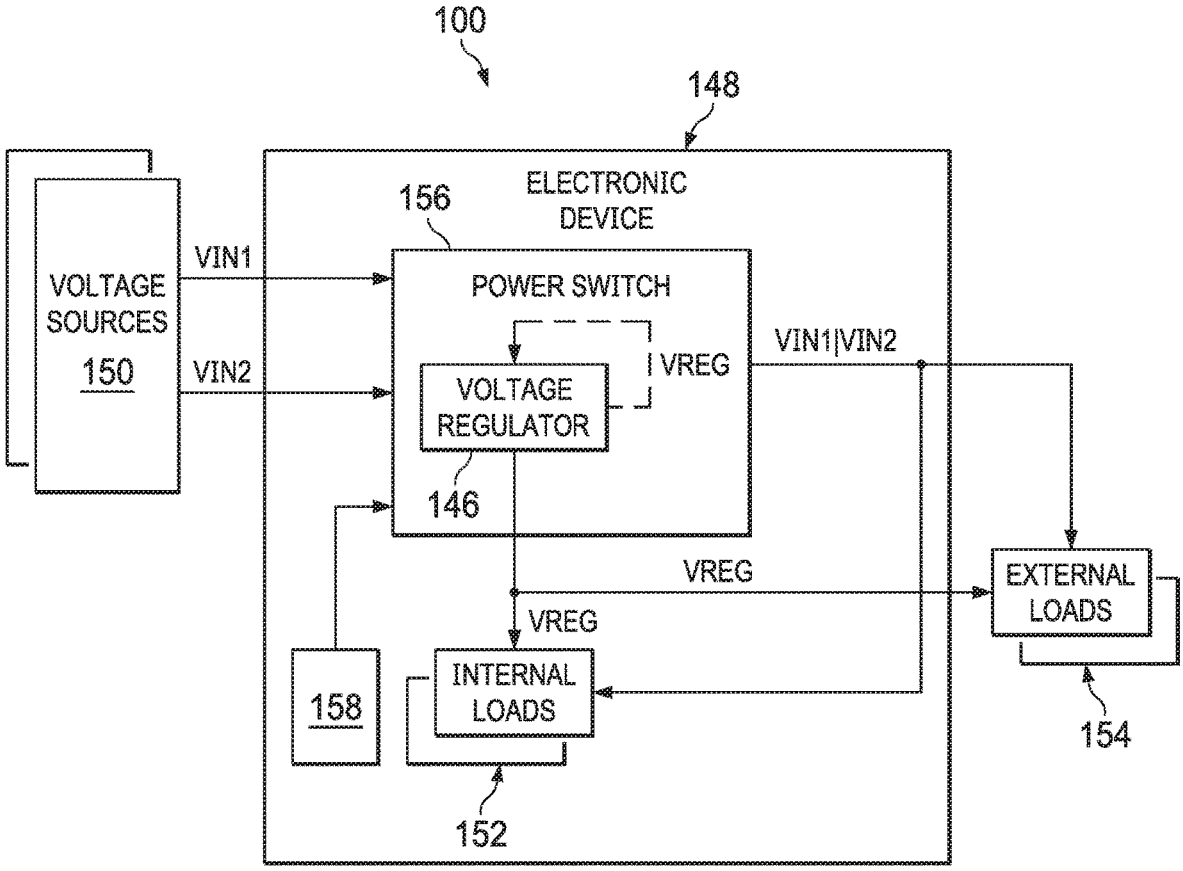
FIG. 1 is an illustration of an example system including a dual-input LDO voltage regulator according to embodiments of the present disclosure.

Embodiments of the present disclosure include an LDO voltage regulator. The LDO voltage regulator may include a first voltage input, a second voltage input, a regulated voltage output, a first blocking diode, and a second blocking diode. The LDO voltage regulator may include circuitry configured to block leakage to the first voltage input with the first blocking diode when the first voltage input is less than the regulated voltage output, and to provide the regulated voltage output from the first voltage input and the second voltage input. The circuitry may be implemented by analog circuitry, digital circuitry, or any combination thereof. The blocking diodes may be implemented using transistors. The leakage may be current or voltage leakage. The blocking diodes may be implemented between voltage follower transistors and the regulated voltage output.

In combination with any of the above embodiments, the circuitry may be further configured to block leakage to the second voltage input with the second blocking diode when the second voltage input is less than the regulated voltage output. In combination with any of the above embodiments, the LDO voltage regulator may further include internal devices configured to be operated by the regulated voltage output. Such internal devices may include charge pumps, voltage sources, amplifiers, transistors, diodes, or other electronic devices that are used in the voltage regulator.

In combination with any of the above embodiments, the LDO regulator may further include an output tank bypass capacitor.

In combination with any of the above embodiments, the first blocking diode and the second blocking diode may be implemented by active diodes. The active diodes may be implemented by transistors. The active diodes may be controlled by a comparator. A first control input of the first blocking diode may be connected to an anode of the second blocking diode. A second control input of the second blocking diode may be connected to an anode of the first blocking diode.

In combination with any of the above embodiments, the first blocking diode and the second blocking diode are implemented by transistors.

In combination with any of the above embodiments, the first voltage input is connected to the first blocking diode through a first transistor. The first transistor may be an n-channel transistor. The second voltage input may be connected to the second blocking diode through a second transistor. The second transistor may be an n-channel transistor. The first and second transistors may be configured to operate as voltage followers with respect to one another.

Further descriptions of embodiments of the LDO voltage regulators are described below within the context of the figures.

Embodiments of the present disclosure may include a microcontroller. The microcontroller may include a first voltage source, a second voltage source, and any of the LDO voltage regulators of the above embodiments. The first voltage source and second voltage source may be respectively connected to the first and second voltage inputs of the LDO voltage regulator.

Embodiments of the present disclosure may include a method. The method may include operation of any of the microcontrollers or LDO voltage regulators of the above embodiments.

FIG. 1 is an illustration of an example system 100 including a dual-input LDO voltage regulator according to embodiments of the present disclosure. Such a regulator may include voltage regulator 146. In one embodiment, voltage regulator 146 may be implemented using dual LDO voltage regulator output stages in parallel and reverse blocking diode topology. In a further embodiment, voltage regulator 146 may be implemented with active diodes. Voltage regulator 146 is illustrated in more detail in FIG. 2, below.

System 100 may include an implementation of voltage regulator 146 within any suitable context. For example, voltage regulator 146 may be implemented within a power switch, controller, microcontroller, power supply, laptop, mobile device, vehicle, or any other suitable electronic device. In the example of FIG. 1, voltage regulator 146 may be implemented within an electronic device 148, and further within a power switch 156 within such an electronic device 148. Electronic device 148 may in turn implement fully or in part a power controller, power supply, or portion of a laptop, mobile device, microcontroller, vehicle, or any other suitable electronic device. In one embodiment, power switch 156 may be implemented as a microcontroller. Power switch 156 may be configured to receive two or more voltage inputs, such as VIN1 and VIN2 from respective voltage sources 150. Voltage sources 150 are illustrated as outside electronic device 148, but may be implemented inside electronic device 148. Power switch 156 may be configured to selectively route inputs VIN1 or VIN2 to any suitable destination or load, such as one or more internal loads 152 of electronic device 148 or one or more external loads 154. Power switch 156 may be configured to connect together VIN1 and VIN2 in order to supply VIN2 from VIN1 or vice versa. Internal loads 152 may include, for example, any suitable consumer of power, such as portions of electronic device 148, processors, circuits, peripherals, or any other suitable electronic device or portion thereof. External loads 154 may include, for example, any suitable consumer of power, such as a circuit, semiconductor die, chip, or other suitable electronic device.

Voltage regulator 146 may be configured to provide a continuous, steady voltage, when possible, to one or more loads in system 100. For example, voltage regulator 146 may be configured to provide the voltage VREG. Voltage VREG may be designed to have the value, for example, of 3.3 volts. Voltage VREG may be provided to any suitable loads. For example, voltage regulator 146 may be configured to provide voltage VREG to one or more external loads 154 or one or more internal loads 152.

In one embodiment, voltage regulator 146 may be configured to provide voltage VREG for its own operation. In another embodiment, voltage regulator 146 may be configured to provide voltage VREG for the operation of power switch 156. In yet another embodiment, voltage regulator 146 may be configured to provide voltage VREG using inputs VIN1 and VIN2. In still yet another embodiment, voltage regulator 146 may be configured to provide voltage VREG under circumstances wherein one or both of inputs VIN1 and VIN2 are less than the designed value of VREG.

Figure 2:
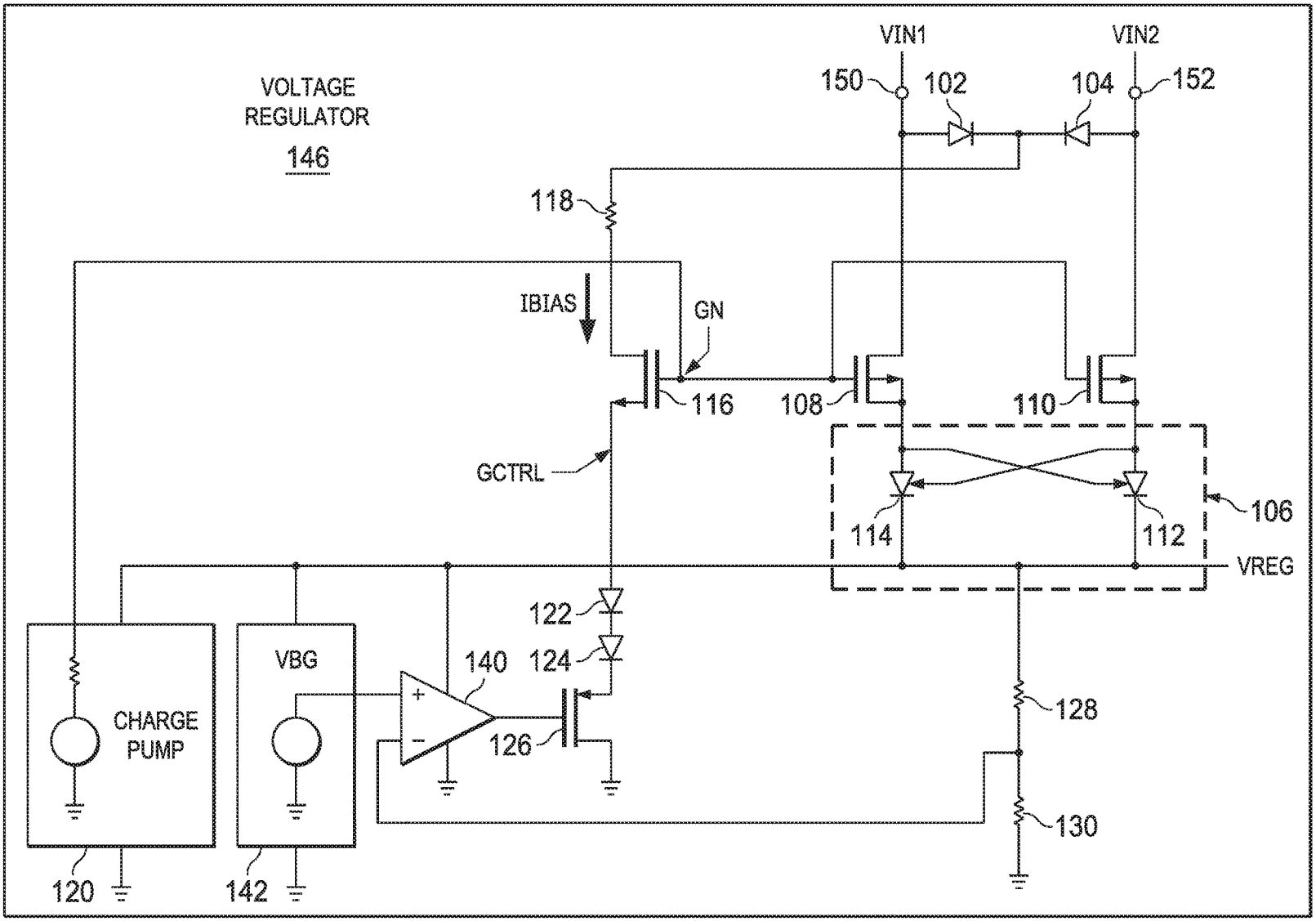
FIG. 2 is an illustration of an example dual-input LDO voltage regulator, according to embodiments of the present disclosure.

FIG. 2 is a more detailed illustration of voltage regulator 146, according to embodiments of the present disclosure.

Voltage regulator 146 may be a dual-input voltage regulator, with inputs VIN1 and VIN2 inputs. Input VIN1 may enter voltage regulator 146 through a port 150. Input VIN2 may enter voltage regulator 146 through a port 152. Inputs VIN1 and VIN2 may be voltage inputs with an input range of 0-22 volts. In some implementations, inputs VIN1 and VIN2 may be current inputs. Thus, inputs VIN1 and VIN2 may be considered "high voltage". The active range of inputs VIN1 and VIN2 may be 2.5-22 volts, wherein inputs VIN1 and VIN2 are available to be switched and to supply voltage regulator 146 with power when the respective ones of inputs VIN1 and VIN2 are above 2.5 volts and below 22 volts. Voltage regulator 146 may be configured to prevent any leakage to inputs VIN1 or VIN2 if a respective one of inputs VIN1 or VIN2 is less than VREG voltage. In order to prevent such leakage, a reverse blocking diode may be implemented on output stages in voltage regulator 146 between both inputs VIN1 and VIN2 and output stages to voltage VREG. The maximum dropout voltage in LDO mode for voltage regulator 146 may be 100 millivolts. Such a condition may be, for example, when both inputs VIN1 and VIN2 are less than 3.4 volts. In order to enforce such a low maximum dropout voltage, the reverse blocking diodes may be active diodes to prevent the dropout voltage from being significantly degraded by the typical forward voltage drop of about 0.7 volts of a standard diode. When a standard diode is used, the dropout voltage is often not less than 0.7 volts. In contrast, an active diode of voltage regulator 146 may have a forward bias voltage less than 100 millivolts. However, an active diode may still drive current when it is slightly (0~30 millivolts) reversed biased. Such a situation may induce current leakage. Such leakage may be current or voltage leakage from VREG to VIN1 or VIN2. Voltage regulator 146 may be configured to operate without an external capacitor connected between voltage VREG and ground when a load is connected to voltage regulator 146. Voltage VREG may be designed to be approximately 3.3 volts. Thus, voltage VREG may be considered a "low voltage".

Voltage regulator 146 may include dual LDO output stages in parallel, implemented by transistors 108, 110. Transistors 108, 110 may be implemented by any suitable transistors. For example, transistors 108, 110 may be implemented by n-channel metal-oxide-semiconductor field effect transistors (MOSFET). Input VIN1 may be connected to the drain of transistor 108. Input VIN2 may be connected to the drain of transistor 110.

Voltage regulator 146 may include a diode 102 connected at its anode to input VIN1. Furthermore, voltage regulator 146 may include a diode 104 connected at its anode to input VIN2. The cathodes of diodes 102, 104 may be connected to each other. Furthermore, the cathodes of diodes 102, 104 may be connected to a first end of a resistor 118. A second end of resistor 118 may be connected to the gates of transistors 108, 110.

Voltage regulator 146 may include a n-channel MOSFET transistor 116 whose drain and gate are connected to the second end of resistor 118. This configuration may be referred to as a diode connected transistor. Furthermore, transistor 116 may be implemented instead with a diode-connected p-channel MOSFET transistor (not shown). The source of transistor 116 may be connected to the anode of a first of two diodes 122, 124 connected in series, and the cathode of the two series connected diodes 122, 124 may be connected to a source of a transistor 126. A drain of transistor 126 may be connected to ground. Transistor 126 may be implemented by, for example, a p-channel MOSFET transistor.

Voltage regulator 146 may include a charge pump 120 as input voltage. Charge pump 120 may be implemented in any suitable manner, such as by analog circuitry, digital circuitry, or a combination thereof. Charge pump 120 may be configured to receive voltage VREG. Charge pump 120 may be configured to provide output voltage proportional to voltage VREG. For example, charge pump 120 may be implemented as a voltage doubler (wherein voltage output is double voltage input). However, a charge pump might not be an ideal voltage source, as it may include a series output resistance that depends on the value of the pumping capacitance and the pumping frequency. Typically, the series resistance of a charge pump voltage doubler is equal to 1/(pumping frequency*pumping capacitance). Accordingly, charge pump 120 may be represented as an equivalent voltage source and an equivalent resistance with values of $$V_{chargepump} = 2 * VREG$$

$$R_{chargepump} = \frac{1}{F_{chargepump} * C_{chargepump}}$$

wherein $F_{chargepump}$ is the frequency of a clock source in or provided to charge pump 120, such as 2 MHz, and $C_{chargepump}$ is the charge pump capacitance, such as 0.9 pF. If the frequency is 2 MHz and the capacitance is 0.9 pF, then the equivalent resistance of charge pump 120 may be 550 KΩ. Charge pump 120 may be configured to provide voltage to the gate and drain of transistor 116. The output of charge pump 120 may be further connected to the gates of transistors 108, 110. A node receiving such output of charge pump 120 may be denoted as GN.

Voltage regulator 146 may include a reference voltage source 142. Reference voltage source 142 may be implemented in any suitable manner. For example, reference voltage source 142 may be implemented by a bandgap voltage with a value of VBG, available from a part of a semiconductor die or microcontroller. Internal regulating circuitry of voltage regulator 146 may be powered by voltage VREG.

The source of transistors 108, 110 may be connected to a reverse blocking diode circuit 106. Reverse blocking diode circuit 106 may be implemented in any suitable manner. In one embodiment, reverse blocking diode circuit 106 may be implemented using a pair of active diodes 112, 114. Active diodes 112, 114 may be implemented in any suitable manner, such as by MOSFETs. As indicated above, active diodes 112, 114 prevent current or voltage leakage from VREG to VIN1 or VIN2. The anode of active diode 112 may be connected to the source of transistor 110. The cathode of active diode 112 may be connected to an output node for voltage VREG. Active diode 114 may be connected at its anode to the source of transistor 108. Active diode 114 may be connected at its cathode to the output node for VREG. Active diodes 112, 114 may be cross-coupled to one another's transistor-side end. Active diode 112 operation may be controlled by the differential voltage between the source of transistor 108 and the anode of active diode 112 that is also the source of transistor 110. Active diode 114 operation may be controlled by differential voltage between the source of transistor 110 and the anode of active diode 114 that is also the source of transistor 108. The operation of the active diodes may be controlled by the differential voltage between the sources of transistors 108, 110. The control of active diode 112 may include allowing current to flow from the source of transistor 110 to the output node for voltage VREG when differential voltage between the source of transistor 108 and the source of transistor 110 is less than a threshold voltage. The control of active diode 114 may include allowing current to flow from the source of transistor 108 to the output node for voltage VREG when differential voltage between the source of transistor 110 and the source of transistor 108 is less than a threshold voltage. The threshold voltages may be, for example, 20 millivolts. More detailed implementations of reverse blocking diode circuit 106 are illustrated below within the context of FIG. 3.

Voltage regulator 146 may include a resistive feedback network, including resistor 128 connected at its second end to a first end of resistor 130. A first end of resistor 128 may be connected to the output node for voltage VREG. A second end of resistor 130 may be connected to ground. The second end of resistor 128 and the first end of resistor 130 may be connected to an inverting input of an amplifier 140. The non-inverting input of amplifier 140 may be connected to the output of reference voltage source 142. The output of amplifier 140 may be connected to the gate of transistor 126. The resistive feedback network may operate as a resistive divider providing an output voltage (VFB) equal to ((VREG*resistance of resistor 130)/(resistance of resistor 128+resistance of resistor 130)). Amplifier 140 may be configured to monitor the loop in order to have the VFB equal to the voltage of VBG. When the VFB voltage becomes less than the VBG voltage, amplifier 140 may be configured to increase its output voltage in order to allow VFB to rise to again be equal to the VBG voltage. The voltage on the source of transistor 126 increases accordingly, and thus the voltage at GN also increases. Increasing the voltage at GN induces an increase of VREG voltage so the VFB voltage rises to be equal, again, to the voltage of VBG. If the voltage of VFB becomes higher than the voltage of VBG, then amplifier 140 may be configured to lower its output voltage and the voltage at GN is decreased, so that VFB voltage decreases. Finally, the VREG voltage is equal to (VBG*((resistance of resistor 128+resistance of resistor 130)/resistance of resistor 130)).

Using a PMOS transistor for driving the cathode of diode 124 induces a voltage follower behavior (that non-inverting) between the output of amplifier 140 and the cathode of diode 124. In other implementations, transistor 126 may be an NMOS transistor, having its source connected to ground and its drain connected to the cathode of diode 124. However, using an NMOS transistor instead of a PMOS transistor for driving the cathode of diode 124 induces an inverting behavior between the output of the amplifier and the cathode drive of diode 124. Therefore, the connection of the positive and negative inputs of the amplifier must be swapped in such a case to compensate the inverting behavior of NMOS type transistor 126.

Thus, PMOS type or NMOS type transistors may be used. However, a PMOS type transistor may be used as it may be easier to stabilize for such an application.

Diodes 122, 124 may be configured to provide sufficient self-startup voltage for a control loop (not shown) for generation of voltage VREG. The voltage on the anode of diode 122, denoted GCTRL, may be at least two times a junction voltage of diodes 122, 124 and thus at least, for example. 1.4 volts. Transistor 116 may be configured to operate as a threshold voltage compensator for the threshold voltage, Vthn, of transistors 108 and 110. Transistor 116 may be biased with a low current. Therefore, voltage at node GN may be at least (1.4 volts+Vthn). Transistors 108, 110 may be relatively large and strong source follower transistors since transistors 108, 110 may be sized to have a maximum dropout voltage of 100 millivolts. Moreover, the circuitry whose voltage is supplied by VREG may be designed in such a way that current consumption from VREG is relatively low, in the range of 10 to 100 microamps during power-up. Under these conditions, the gate to source voltage of transistors 108,110 may be equal to their threshold voltage Vthn. As a consequence, the source voltage for transistors 108,110 may be equal to GCTRL node voltage, thus at least 1.4 volts. The dropout voltage on active diodes 112,114 is relatively very low since transistors 108, 110 and active diodes 112, 114 are sized to achieve a maximum cumulated drop out voltage of 100 millivolts. Therefore, the voltage VREG may be at least 1.4 volts during power-up. 1.4 volts is sufficiently large to operate portions of voltage regulator 146 such as charge pump 120, amplifier 140, or other elements (not shown) activated during power-up. Thus, the voltage drop across diodes 122, 124 may be a self-startup voltage.

Diodes 102, 104 in combination with resistor 118 may provide a supply path to generate the self-startup voltage. When either VIN1 or VIN2 input, or both VIN1 and VIN2 inputs are higher than (VREG+Uj+Vthn), wherein Uj is the junction voltage of a diode, diodes 102, 104 and resistor 118 may contribute to provide a fraction of the current for the branch of the regulating loop including transistor 116, diodes 122, 124, and transistor 126. The rest of the current of such a branch may be provided by charge pump 120. However, when both inputs VIN1, VIN2 are less than (VREG+Uj+Vthn), then no current at all is flowing through this supply path since neither input VIN1 nor input VIN2 is sufficiently large enough to provide the Uj "on" voltage for diodes 102, 104. In this situation, only charge pump 120 is able to provide a supply current to the transistor 116, diodes 122, 124, and transistor 126 branch.

The regulating loop is based on a class A amplifier for which the output pull-up resistor is the output resistance of charge pump 120. The core of the regulating loop includes resistors 128, 130, reference voltage source 142, amplifier 140, transistors 108, 110, reverse blocking diode circuit 106, transistor 116, diode 122, 124, and transistor 126.

The output resistance of charge pump 120 may define sizing of transistors 116, 126 and diodes 122, 124. The current flowing into diodes 102,104 and resistor 118 adds to the current flowing from charge pump 120. Accordingly, resistor 118 should preferably have a very high value, such as several megaohms, in order to limit the current flowing through this path. While a particular mechanism of providing startup current has been shown, other techniques, such as using a floating current source, may be used.

Embodiments of the present disclosure of voltage regulator 146 may address challenges arising from implementing inputs from high voltage to regulation at low voltage, such as large die requirements for comparing high voltage values, by performing comparisons of lower voltage values, such as those available from transistors 108, 110. Embodiments of the present disclosure of voltage regulator 146 may utilize a follower structure of LDO voltage regulator stages such as those implemented by transistors 108, 110 to yield information that inputs VIN1 or VIN2 is less than voltage VREG. Such information may be available in low voltage circuitry in voltage regulator 146, such as reverse blocking diode circuit 106. Such information is the differential voltage between the sources of transistors 108, 110, operating as voltage followers.

If inputs VIN1 and VIN2 are both greater than voltage VREG, both transistors 108, 110 may be switched on as source follower transistors, and thus the same respective voltage may be present on the respective sources of transistors 108, 110. The voltage on the source of transistor 108 may further activate diode 112 and the voltage on the source of transistor 110 may further activate diode 114. Thus, diodes 112, 114 may allow current to flow from sources of transistors 108, 110 to an output node for voltage VREG, with the current flow being equally shared from both inputs VIN1 and VIN2. The current flowing into diodes 112 and 114 is thus the same, which induces the same voltage drop across diodes 112 and 114. Therefore, the differential voltage between the sources of transistors 108 and 110 is zero.

If one of inputs VIN1 or VIN2 is less than VREG, the current to VREG only flows from the one of VIN1 or VIN2 inputs that is greater than VREG.

If input VIN1 is less than voltage VREG, with any value down to zero, and input VIN2 is greater than voltage VREG, the source of transistor 108 is also lower than voltage VREG while the source of transistor 110 is higher than voltage VREG. This induced differential voltage is detected and diode 114 is turned off. This behavior applies to any input VIN1 voltage that is lower than voltage VREG down to zero and any VIN2 voltage greater than VREG up to the maximum allowed voltage (such as 22 volts).

If input VIN2 is less than voltage VREG, with any value down to zero, and input VIN1 voltage is greater than VREG, the source of transistor 110 is also lower than voltage VREG while the source of transistor 108 is higher than voltage VREG. This induced differential voltage is detected and diode 112 is turned off. This behavior applies to any input VIN2 voltage lower than VREG down to zero and any VIN1 voltage greater than VREG up to the maximum allowed voltage (such as 22 volts).

Active diodes 114, 112 are illustrated in further detail below within the context of FIG. 3.

Figure 3:
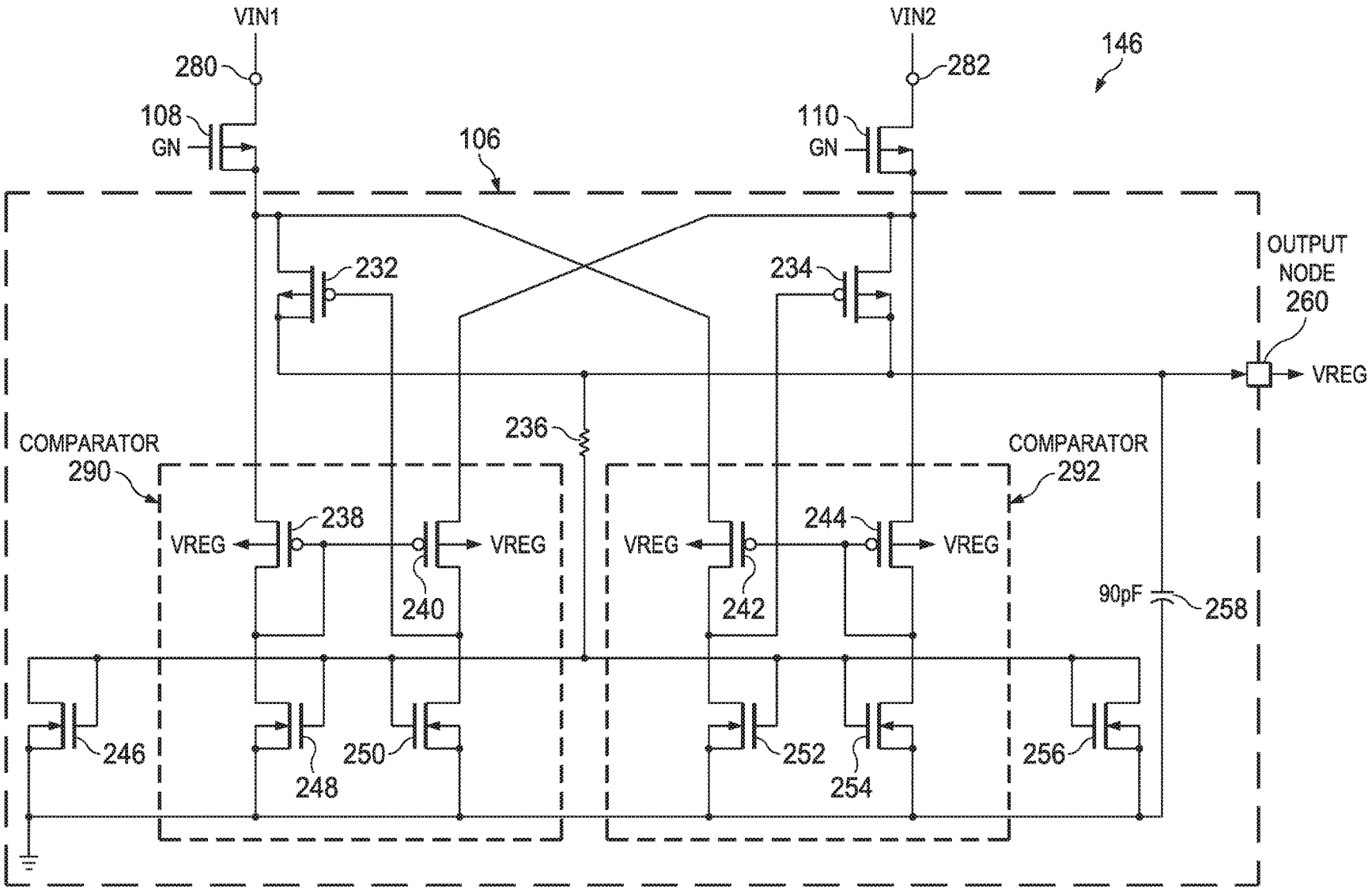
FIG. 3 is a more detailed illustration of portions of the dual-input LDO voltage regulator, according to embodiments of the present disclosure.

FIG. 3 is a more detailed illustration of portions of voltage regulator 146, according to embodiments of the present disclosure. In particular, a more detailed illustration of reverse blocking diode circuit 106 is illustrated within the context of voltage regulator 146.

Reverse blocking diode circuit 106 may include transistors 232, 234, 238, 240, 242, 244, 246, 248, 250, 252, 254, 256, and resistor 236, of which each may be implemented in any suitable manner. Transistors 232, 234, 238, 240, 242, 244 may be implemented by p-channel MOSFETs. Transistors 246, 248, 250, 252, 254, 256 may be implemented by n-channel MOSFETs. Resistor 236 may have a value of 1.4 megaohms. Capacitor 258 is the regulator output tank (bypass) capacitor and may have a value of 90 picofarads.

The source of transistor 232 may be connected to the source of transistor 108. The source of transistor 234 may be connected to the source of transistor 110. The drain and body of transistor 232 and the drain of transistor 234 may be connected to an output node 260 for voltage VREG. Furthermore, the drain and body of transistor 232 and the drain and body of transistor 234 may be connected to a first end of resistor 236.

The body of transistors 238, 240, 242, 244 may be connected to the output node 260 for voltage VREG. The source of transistor 238 may be connected to the source of transistor 108. The source of transistor 240 may be connected to the source of transistor 110. The source of transistor 242 may be connected to the source of transistor 108. The source of transistor 244 may be connected to the source of transistor 110. The gates of transistors 238, 240 may be connected to each other and further to the drain of transistor 238. The gates of transistors 242, 244 may be connected to each other and further to the drain of transistor 244. The gate of transistor 232 may be connected to the drain of transistor 240. The gate of transistor 234 may be connected to the drain of transistor 242. This configuration may be atypical in LDO voltage regulators of the prior art. However, this configuration may allow LDO voltage regulator 146 to start operating through an intrinsic source of body diodes of transistors 232, 234. If a voltage is present at the source of transistor 108 and voltage VREG is equal to zero volts or very low, the intrinsic source to body of transistor 232 is forward biased and pulls up voltage VREG. Moreover, this may cause transistor 232 to be used as an active diode that is completely off when needed. Similarly, if a voltage is present at the source of transistor 110 and voltage VREG is equal to zero volts or very low, the intrinsic source to body of transistor 234 is forward biased and pulls up voltage VREG. Moreover, this may cause transistor 234 to be used as an active diode that is completely off when needed. Transistor 232 may be completely off when, for example, input VIN1 is less than voltage VREG. Transistor 234 may be completely off when, for example, input VIN2 is less than VREG. Thus, transistors 232, 234 may operate as active diodes.

Each of transistors 238, 240, 242 and 244 may have their source and body tied together. Thus, each transistors 238, 240, 242 and 244 may be laid out in its individual well, but this may induce a larger layout area for this group of transistors.

The gates of transistors 246, 248, 250, 252, 254, 256 may be connected to a second end of resistor 236. The sources of transistors 246, 248, 250, 252, 254, 256 may be connected to ground. The drain of transistor 246 and the drain of transistor 256 may be connected to the second end of resistor 236. Transistors 246, 256 may be connected in parallel and thus could be implemented as a single device. However, implementing these separately may improve overall symmetry and thus overall performance of voltage regulator 146. The drain of transistor 248 may be connected to the drain of transistor 238. The drain of transistor 250 may be connected to the drain of transistor 240. The drain of transistor 252 may be connected to the drain of transistor 242. The drain of transistor 254 may be connected to the drain of transistor 244.

Capacitor 258 may be connected between an output node 260 for voltage VREG and ground. Capacitor 258 may be of a relatively small size, such as 90 picofarads. The relatively small size of capacitor 258 may allow capacitor 258 to be implemented within voltage regulator 146, in contrast to a larger capacitor which might need to be an external capacitor and implemented outside of voltage regulator 146. The small size of capacitor 258 may be enabled by embodiments of the present disclosure. In particular, the small size of capacitor 258 and thus inclusion within voltage regulator 146 may be enabled by the use of an NMOS source follower output stage such as transistors 108, 110.

Active diode 114 may be implemented in FIG. 3 by transistor 232. Active diode 112 may be implemented in FIG. 3 by transistor 234. Transistors 238, 240, 248, 250 may implement a differential amplifier to control the operation of transistor 232. Transistors 242, 244, 252, 254 may implement a differential amplifier to control the operation of transistor 234. Transistors 246, 256 may operate as a global bias for transistors 246, 250, 252, 254.

In order to reduce a pin count of voltage regulator 146, in one embodiment, no output pin might be provided for external access to internal regulated voltage. In such an embodiment, voltage VREG might not be provided to other elements outside voltage regulator 146.

Transistors 238, 240, 248 and 250 may implement a comparator 290 that drives transistor 232 (which in turn implements an active diode). Transistors 242, 244, 252 and 254 implement a comparator 292 that drives transistor 234 (which in turn implements an active diode).

If transistors 238, 240 are identical and if transistors 248, 250 are identical then comparator 290 has no offset. However, implementing transistor 250 as 50% wider than transistor 248 induces an offset of 20 millivolts. Accordingly, when the differential voltage at the input of comparator 290 is zero, implementing transistor 250 as 50% wider than transistor 248 causes the output of comparator 290 to be zero, making transistor 232 operate as an active diode that is fully "on". As discussed above, the differential voltage between source of transistors 108, 110 is zero when both inputs VIN1 and VIN2 are greater than voltage VREG. Under this condition, both diodes 232, 234 are to be "on" which implies that the gate voltage of transistors 108, 110 must be zero. Implementing a 20 millivolt offset in comparator 290 and in comparator 292 (by implementing transistor 252 as 50% wider than transistor 254) configures both diodes 232, 234 to be fully "on' when both inputs VIN1 and VIN2 are greater than VREG. This condition remains until source voltage of transistor 108 is 20 millivolts below source voltage of transistor 110, or source voltage of transistor 110 is 20 millivolts below source voltage of transistor 108.

Consider the case wherein input VIN2 is at least 100 millivolts higher than voltage VREG, and input VIN1 was higher than voltage VREG but input VIN1 has started to fall. The source voltage of transistor 108 starts becoming lower than the source voltage of transistor 110 when input VIN1 voltage is equal or lower than voltage VREG. Then, differential voltage between the sources of transistor 108, 110 increases when input VIN1 becomes lower than voltage VREG. Current starts to flow from VREG to input VIN1 as soon as input VIN1 is less than voltage VREG. This induces a cross-conduction condition between inputs VIN2 and VIN1: input VIN2 supplies VREG that in turn supplies input VIN1, such that input VIN2 supplies input VIN1. Ideally this situation should not occur. However, such a phenomena may be only marginally harmful and may disappear quickly. The differential offset of 20 millivolts that induces transistor 232 to be disconnected, a triggering point, is typically reached when input VIN1 is in a range of five to fifty millivolts below voltage VREG. The exact value of the triggering point depends on relative sizing of transistors 108,110 and transistors 232, 234. As soon as the triggering point is reached, transistor 232 is switched "off" removing the path from VREG to input VIN1 and thus the path from input VIN2 to input VIN1. Removing this path causes differential voltage between the source of transistor 108 and the source of transistor 110 to increase. A small positive drop, Vdrop_cross, of a few millivolts between the source and drain of transistor 108 may have occurred. This cross-conduction voltage drop was due to the current flowing from the source of transistor 108 to the drain of transistor 108. This voltage drops to zero as soon as transistor 232 is turned "off" since the cross-conduction current flowing into transistor 108 is cancelled. As a consequence, the voltage on the source of transistor 108 is reduced by Vdrop_cross. At the same time, the current flowing into transistor 110 that was equal to the regulated current (that is, the current provided to the output of VREG) plus the cross-conduction current drops to the regulated current. This induces an increase of the source voltage of transistor 110 of about Vdrop_cross. Finally, the differential voltage at the input of comparator 290 jumps from 20 millivolts to about 20 millivolts plus two times Vdrop_cross when transistor 232 is turned "off". Accordingly, transistor 232 is safely locked "off". This avoids oscillations when the triggering point of comparator 290 is reached. In order to turn transistor 232 "on" again, input VIN1 would increase by two times Vdrop_cross. Accordingly, reverse blocking diode circuit 106 has a hysteresis of approximately two times Vdrop_cross, typically 10 to 20 millivolts. This may be referred to as a built-in hysteresis. Usually, the triggering point where transistor 232 turns "off" occurs when input VIN1 is equal to voltage VREG. From this point, for further values of input VIN1 down to zero volts, transistor 232 remains off.

Assume that input VIN2 is now still at least equal to voltage VREG plus 100 millivolts, and that input VIN1 starts ramping up from zero (or any value between zero and voltage VREG). The source voltage of transistor 108 is equal to input VIN1 since transistor 108 is "on" and no current is flowing through (transistor 232 is "off"). In order to turn "on" transistor 232 again, input VIN1 has to rise to (2*Vdrop_cross) above the point where input VIN1 was disconnected during the ramping down of input VIN1, thus ramping up to about VREG voltage.

Thus, assuming that input VIN2 is at least 100 millivolts higher than voltage VREG and Vdrop_cross is 10 millivolts, the voltage to trigger transistor 232 to turn "on" is about voltage VREG for input VIN1 ramping up from a value that is less than voltage VREG and the voltage to trigger transistor 232 to turn "off" is about (voltage VREG—20 millivolts) for input VIN1 ramping down from a value that is higher than voltage VREG.

In the example above, comparator 290 senses differential voltage between the sources of transistors 108, 110 to operate transistor 232. Similarly, comparator 292 senses differential voltage between the sources of transistors 108, 110 to operate transistor 234. In another embodiment, the differential voltage between the source of transistor 108 and voltage VREG could be used. However, such an embodiment might not benefit from a gain in sensitivity that is achieved when sensing is done between the sources of transistors 108, 110.

The built-in offset of 20 millivolts may configure both paths for inputs VIN1 and VIN2 to be activated when both inputs VIN1 and VIN2 are greater than voltage VREG. The offset minimizes the overall dropout voltage of voltage regulator 146 since both inputs VIN1 and VIN2 are operating in parallel. Ideally, this value could be dramatically reduced if each device of voltage regulator 146 was perfectly matched, inducing true zero differential voltage between sources of transistor 108, 110 when both inputs VIN1 and VIN2 are higher than voltage VREG. However, in practice when both inputs VIN1 and VIN2 are greater than voltage VREG, the differential voltage between the sources of transistors 108, 110 may be in the range of 5-10 millivolts. Moreover, the real built-in offset may differ from the designed value, as much as 5-10 millivolts. Therefore, a built-in offset of 20 millivolts may be a good trade-off that helps configure both VIN1 and VIN2 paths to be activated when both VIN1 and VIN2 are greater than VREG while limiting the cross-conduction current. Reducing this built-in offset reduces the cross-conduction current, but may lead to a situation where the drop out is increased if one of VIN1 or VIN2 is disabled. Increasing the built-in offset to 20 millivolts helps lower possible dropout but increases the cross-conduction current.

As explained earlier, when input VIN1 is less than voltage VREG, the source of transistor 108 is equal to input VIN1 less the voltage drop of transistor 108, since transistor 108 is strongly "on". Furthermore, when input VIN2 is less than voltage VREG, the source of transistor 110 is equal to input VIN2 less the voltage drop of transistor 110, since transistor 110 is strongly "on". This may push transistor 108 or transistor 110 out of their respective safe operating areas. This may occur particularly when one of inputs VIN1, VIN2 are higher than voltage VREG, and the other of inputs VIN1, VIN2 is zero. For example, if input VIN1 is greater than voltage VREG and input VIN2 is zero, then the source of transistor 110 may be equal to zero and the gate to source voltage of transistor 110 is equal to the voltage of GN. The voltage of GN depends on the current flowing through transistor 108 and active diode 232 to voltage VREG. When this current is very low, the voltage value of GN will be about approximately the voltage VREG plus the threshold voltage (Vth) of transistor 108. When the output of voltage regulator 146 is high, the voltage value of GN may be as large as 2*VREG. Accordingly, the gate to source voltage (Vgs) of transistor 110 may be as large as 2*VREG. In many applications, transistors 108, 110, as well as any other transistors operating in the low-voltage domain may have a maximum safe operating region for gate voltage that is close to the voltage VREG, such as 1.1*VREG. Thus, in this example, transistor 110 may have a Vgs voltage outside the safe operation region for most of the applications.

Figure 4:
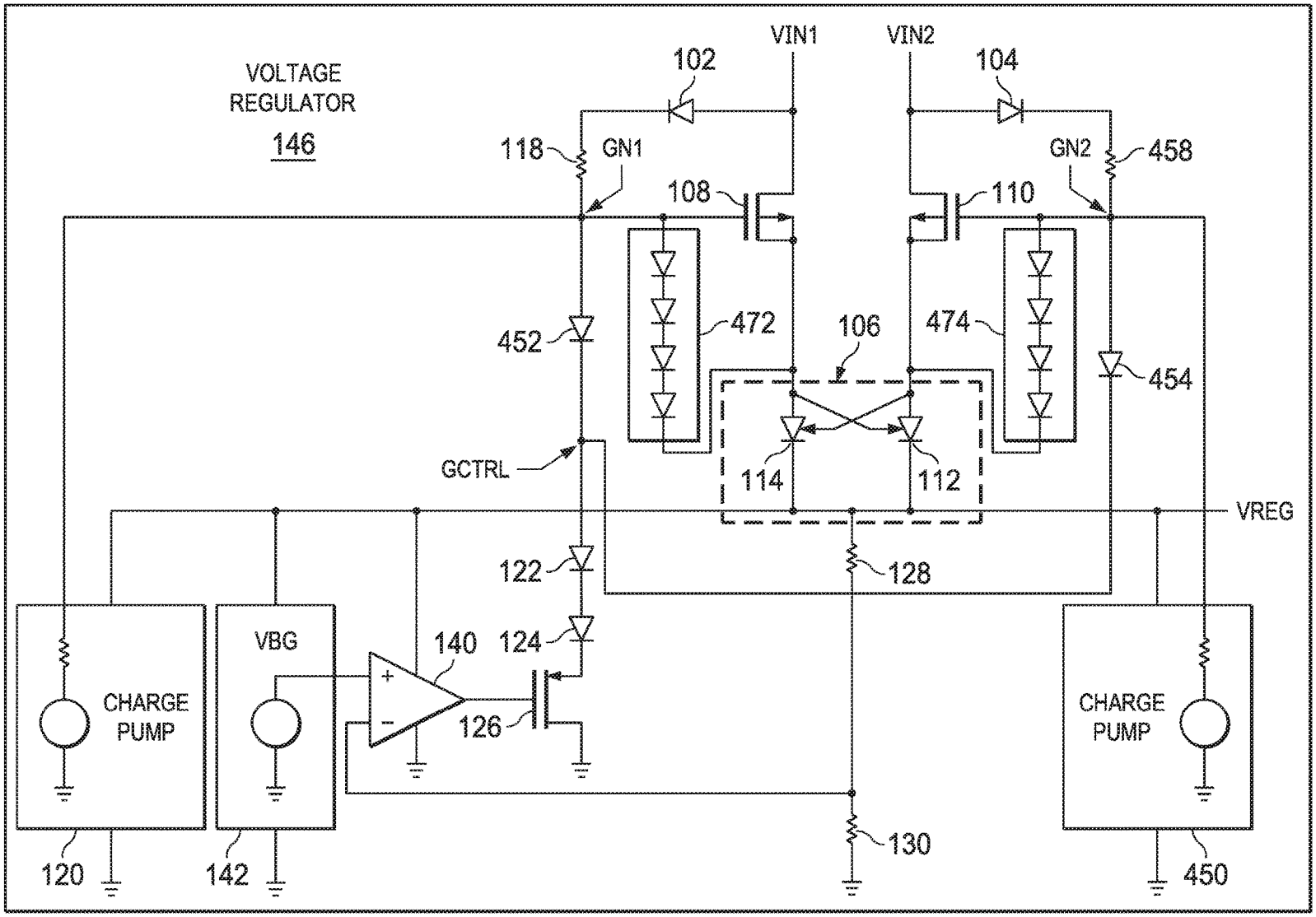
FIG. 4 is another illustration of an example implementation of portions of the dual-input LDO operator, according to embodiments of the present disclosure.

FIG. 4 illustrates further details of an example implementation of voltage regulator 146 to address problems arising from gate to source voltages operating outside of the safe operation region for transistors, according to embodiments of the present disclosure. The implementation of voltage regulator 146 as shown in FIG. 4 may include modifications of FIG. 2. In the example of FIG. 4, another charge pump 450, resistor 458, diodes 452, 454, and gate protection circuits 472, 474 may be added to the implementation of voltage regulator 146 of FIG. 2. Transistor 116 of FIG. 2 might not be used in the example implementation of FIG. 4.

Diode 104 may be connected at its cathode to a first end of resistor 458, instead of to resistor 118 as shown in FIG. 2. A second end of resistor 458 may be connected to the anode of diode 454. Such a connection may also be designated as GN2. The gate of transistor 110 may be connected to GN2 rather than GN as shown in FIG. 2. Output of charge pump 450 may be connected to GN2. The cathode of diode 454 may be connected to a connection point designated as GCTRL. Gate protection circuit 474 may include, for example, a series of four diodes. Gate protection circuit 474 may be connected at the anode end of its first diode to GN2. Gate protection circuit 474 may be connected at the cathode end of its last diode to the source of transistor 110.

Output of charge pump 120 may be to GN1, instead of GN as shown in FIG. 2. GN1 may be connected to the gate of transistor 108. GN1 may be connected to the anode of diode 452. The cathode of diode 452 may be connected to GCTRL. Gate protection circuit 472 may include, for example, a series of four diodes. Gate protection circuit 472 may be connected at the anode end of its first diode to GN1. Gate protection circuit 472 may be connected at the cathode end of its last diode to the source of transistor 108. The anode of diode 102 might not be connected to the anode of diode 104 as shown in FIG. 2. GCTRL may be connected to the cathode of diode 122.

GCTRL may be the main control node for the regulating loop. When both inputs VIN1 and VIN2 are greater than voltage VREG, GN1 and GN2 voltages are equal. Accordingly, voltage regulator 146 may operate in the same way as in FIG. 2. Furthermore, transistor 108 is disconnected from the regulating loop (by diode 114) when input VIN1 is less than voltage VREG and the only active input of the regulating loop is input VIN2 through transistor 110 and diode 112. Similarly, transistor 110 is disconnected from the regulating loop (by diode 112) when input VIN2 is less than voltage VREG and the only active input of the regulating loop is input VIN1 through transistor 108 and active diode 114. However, if the gate drive for transistors 108 and 110 are separated, then GN1 only controls the loop when input VIN2 is less than voltage VREG and GN2 only controls the loop when input VIN1 is less than voltage VREG. Accordingly, as needed GN1 or GN2 may be clamped as explained in further detail below.

Accordingly, in FIG. 4, the gate drive voltage of transistor 108 may be separated from the gate drive voltage of transistor 110. As discussed above, transistor 116 of FIG. 2 might not be used in the example implementation of FIG. 4. Instead, diode 452 may be used. Diode 452 may be implemented by, for example, an intrinsic body-to-source junction diode of a transistor. Resistor 458 may be implemented with a same resistance as resistor 118. Diode 454 may be implemented in the same manner as diode 452.

Accordingly, in FIG. 4, when input VIN1 is higher than voltage VREG and input VIN2 is equal to zero, the voltage VREG is provided through input VIN1. Moreover, the path for input VIN2 is locked by the active reverse blocking diode 112, just as was done in FIG. 2. However, in FIG. 4, the voltage at GN2 at the gate of the transistor 110 is limited to the voltage across gate protection circuit 474. Such a voltage may be, for example, approximately 2.8 volts if four stacked diodes are used in gate protection circuit 474. Such a clamped voltage at GN2 might not affect the regulating loop which, under this condition, includes resistors 128, 130, reference voltage source 142, amplifier 140, diodes 122, 124, and transistor 126 for monitoring GCTRL, and, in currently active path from input VIN1, diode 102, resistor 118, charge pump 120, diode 452, transistors 108 and diode 114. Clamped voltage at GN2 might not affect the active path from input VIN1 since it is isolated from the regulating loop through diode 454 that is now reversed biased, and thus blocked. The current flowing out of charge pump 160 may be equal to (2*VREG−Vclamp)/Rchargepump, and thus may be seven microamps (wherein VREG=3.3 V, Vclamp=2.8 V and Rchargepump=550 kΩ).

When input VIN2 is higher than voltage VREG and input VIN1 is equal to zero, the voltage VREG may be through input VIN2. Moreover, the path for input VIN1 may be blocked by the active reverse blocking diode 114, just as was done in FIG. 2. However, in FIG. 4, the voltage at GN1 on the gate of transistor 108 is limited to the voltage across gate protection circuit 472. Such a voltage may be, for example, approximately 2.8 volts if four stacked diodes are used in gate protection circuit 472. Such a clamped voltage at GN1 might not affect the regulating loop which, under this condition, includes resistor 128, 130, reference voltage source 142, amplifier 140 diodes 122, 124, and transistor 126 for monitoring GCTRL, and, in currently active path from input VIN2, diode 104, resistor 458, charge pump 450, diode 454, transistor 110, and diode 114. Clamped voltage at GN1 might not affect the active path from input VIN1 since it is isolated from the regulating loop through diode 452 that is now reversed biased, and thus blocked. The current flowing out of charge pump 120 may be equal to (2*VREG-Vclamp)/Rchargepump, and thus may be seven microamps (wherein VREG=3.3 V, Vclamp=2.8 V and Rchargepump=550 kΩ).

During normal operation, wherein inputs VIN1 and VIN2 are both greater than voltage VREG, the GN1 and GN2 nodes have the same potential, approximately GCTRL+0.7 V, since the voltage drop on identical diodes 452 and 454 is the same. So VREG current is equally shared from VIN1 and VIN2 as previously discussed.

Figure 5:
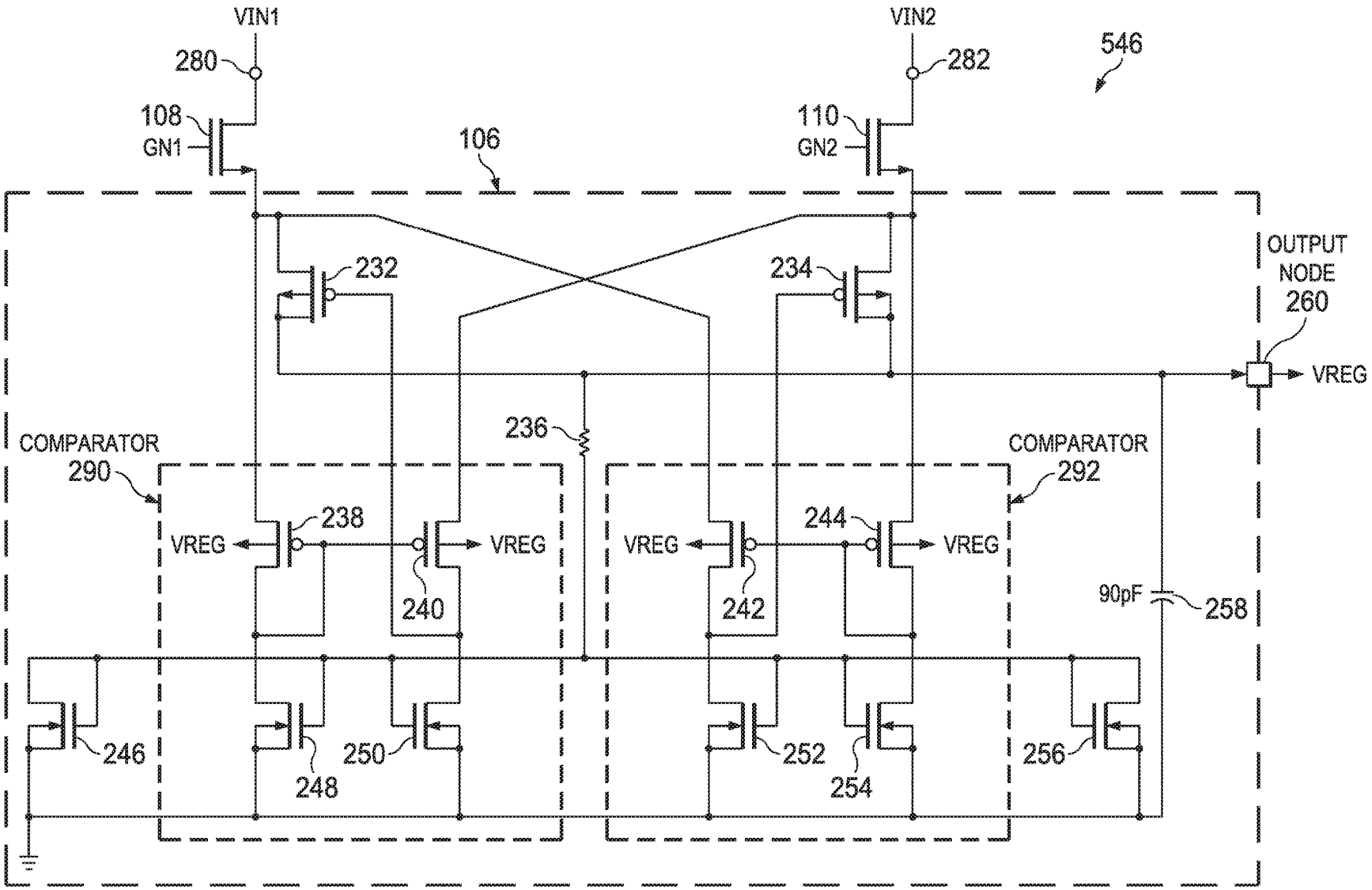
FIG. 5 is another, more detailed illustration of portions of the dual-input LDO voltage regulator, according to embodiments of the present disclosure.

FIG. 5 is an illustration of another, more detailed illustration of portions of voltage regulator 146 that may be used within the context of the implementation of FIG. 4, according to embodiments of the present disclosure. In particular, FIG. 5 illustrates an alternative implementation of voltage regulator 146 as compared to FIG. 3. Instead of connecting the gates of both transistors 108, 110 to the same node GN, in FIG. 5, the gates of transistors 108, 110 may be connected to different nodes. In particular, the gate of transistor 108 may be connected to GN1, as shown in FIG. 4. Moreover, the gate of transistor 110 may be connected to GN2, as shown in FIG. 4. Thus, transistors 108, 110 may be separately operated.

Figure 6:
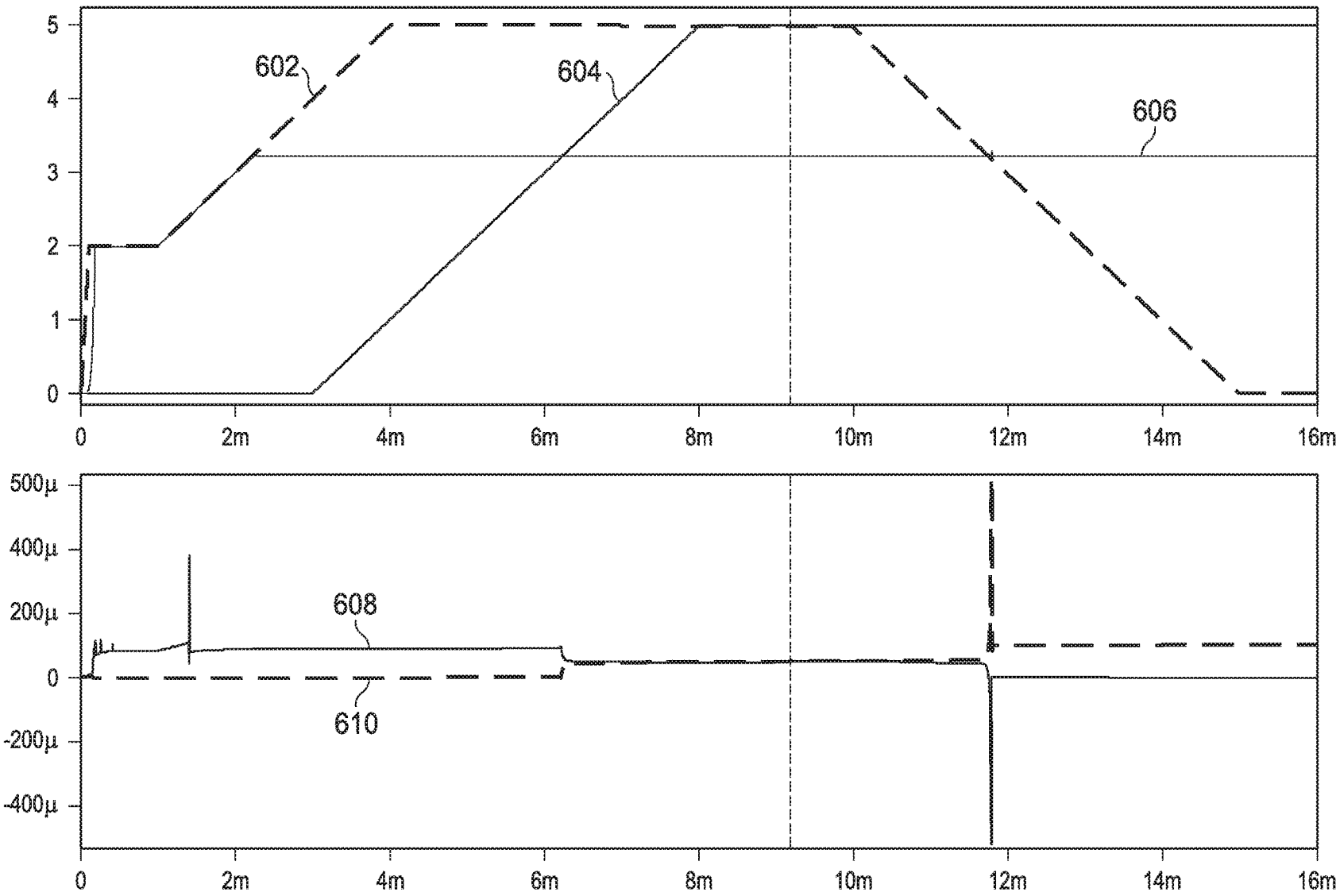
FIG. 6 is an illustration of simulated behavior of the dual-input LDO voltage regulator, according to embodiments of the present disclosure.

FIG. 6 is an illustration of simulated behavior of the dual-input LDO voltage regulator, according to embodiments of the present disclosure.

Trace 602 illustrates example values of input VIN1 changing over time. Trace 604 illustrates example values of input VIN2 changing over time. Trace 606 illustrates voltage VREG resulting from inputs VIN1 and VIN2 over time. Trace 608 illustrates example values of current in a port 150 for input VIN1 over time. Trace 610 illustrates example values of current in a port 152 for VIN2 over time.

At 0 milliseconds, input VIN1 may quickly rise to 2 volts and voltage VREG may follow with a small delay. VIN2 may remain 0 volts. At approximately 1 milliseconds, input VIN1 may begin ramping up to 5 volts and voltage VREG may follow. At approximately 2.1 milliseconds, input VIN may reach the value of the voltage VREG. Subsequently, voltage VREG may leave its following mode and enter a regulating mode. Accordingly, voltage VREG stops following input VIN1 and starts being regulated as 3.3 volts. During this first sequence, input VIN2 may be lower than voltage VREG. Furthermore, the active diode implemented by transistor 234 may be off. Thus, all current that is to supply voltage VREG may be provided by input VIN1 through transistor 108 and the active diode implemented by transistor 232.

At 3 milliseconds, VIN2 may begin ramping up to 5V. As soon as input VIN2 becomes greater than voltage VREG, transistor 234, implementing an active blocking diode, may be turned on. This may enable the output path for VIN2 while the output path of input VIN1 is maintained. The current provided to voltage VREG may be equally shared from ports 150, 152 for inputs VIN1 and VIN2.

At ten milliseconds, input VIN1 may begin ramping down while input VIN2 is maintained at 5 volts. Due to the built-in hysteresis in voltage regulator 146, transistor 232, implementing an active blocking diode on the input VIN1 output path, remain on until input VIN1 falls just below voltage VREG. This induces a cross conduction condition, shown by spikes of current for inputs VIN1 and VIN2 in opposite direction, just before twelve milliseconds. The consumption of current is fully transferred to the port 152 for input VIN2 once input VIN1 falls to zero volts after fourteen milliseconds.

Although the present disclosure has been described in some detail and with reference to particular elements, additions, changes, and equivalent components may be made without departing from the scope of the present disclosure.

What is claimed is:

1. A low dropout (LDO) voltage regulator, comprising:
- a first voltage input;
- a second voltage input;
- a regulated voltage output;
- a first blocking diode;
- a second blocking diode; and
- circuitry configured to:
  - block leakage to the first voltage input with the first blocking diode when the first voltage input is less than the regulated voltage output; and
  - provide the regulated voltage output from the first voltage input and the second voltage input;
- wherein the first blocking diode and the second blocking diode are implemented with active diodes.

2. The LDO voltage regulator of claim 1, wherein the circuitry is further configured to block leakage to the second voltage input with the second blocking diode when the second voltage input is less than the regulated voltage output.

3. The LDO voltage regulator of claim 1, further comprising a plurality of internal devices configured to be operated by the regulated voltage output.

4. The LDO voltage regulator of claim 1, wherein:
- a first control input of the first blocking diode is connected to an anode of the second blocking diode; and
- a second control input of the second blocking diode is connected to an anode of the first blocking diode.

5. The LDO voltage regulator of claim 1, wherein the first blocking diode and the second blocking diode are further implemented by transistors.

6. The LDO voltage regulator of claim 1, wherein:
- the first voltage input is connected to the first blocking diode through a first n-channel transistor;
- the second voltage input is connected to the second blocking diode through a second n-channel transistor; and
- the first and second n-channel transistors are configured to operate as voltage followers with respect to one another.

7. A low dropout (LDO) voltage regulator, comprising:
- a first voltage input;
- a second voltage input;
- a regulated voltage output;
- an output tank bypass capacitor connected within the LDO voltage regulator between the regulated voltage output and ground;
- a first blocking diode;
- a second blocking diode; and
- circuitry configured to:
  - block leakage to the first voltage input with the first blocking diode when the first voltage input is less than the regulated voltage output; and
  - provide the regulated voltage output from the first voltage input and the second voltage input.

8. A microcontroller, comprising:
- a first voltage source;
- a second voltage source; and
- a low-drop-out (LDO) voltage regulator, comprising:
  - a first voltage input configured to receive input from the first voltage source;
  - a second voltage input configured to receive input from the second voltage source;
  - a regulated voltage output;
  - a first blocking diode;
  - a second blocking diode; and
  - circuitry configured to:
    - block leakage to the first voltage input with the first blocking diode when the first voltage input is less than the regulated voltage output; and
    - provide the regulated voltage output from the first voltage input and the second voltage input;
- wherein the first blocking diode and the second blocking diode are implemented with active diodes.

9. The microcontroller of claim 8, wherein the circuitry is further configured to block leakage to the second voltage input with the second blocking diode when the second voltage input is less than the regulated voltage output.

10. The microcontroller of claim 8, wherein the LDO further comprises a plurality of internal devices configured to be operated by the regulated voltage output.

11. The microcontroller of claim 8, wherein:
- a first control input of the first blocking diode is connected to an anode of the second blocking diode; and
- a second control input of the second blocking diode is connected to an anode of the first blocking diode.

12. The microcontroller of claim 8, wherein the first blocking diode and the second blocking diode are further implemented by transistors.

13. The microcontroller of claim 8, wherein:

the first voltage input is connected to the first blocking diode through a first n-channel transistor;

the second voltage input is connected to the second blocking diode through a second n-channel transistor; and the first and second n-channel transistors are configured to operate as voltage followers with respect to one another.

14. A microcontroller, comprising:

a first voltage source;

a second voltage source; and a low-drop-out (LDO) voltage regulator, comprising:

a first voltage input configured to receive input from the first voltage source;

a second voltage input configured to receive input from the second voltage source;

a regulated voltage output;

a first blocking diode;

an output tank bypass capacitor connected within the LDO voltage regulator between the regulated voltage output and ground;

a second blocking diode; and circuitry configured to:

block leakage to the first voltage input with the first blocking diode when the first voltage input is less than the regulated voltage output; and provide the regulated voltage output from the first voltage input and the second voltage input.

15. A method, comprising, in a low-drop-out (LDO) voltage regulator:

at a first voltage input, receiving input from a first voltage source;

at a second voltage input, receiving input from a second voltage source;

providing a first blocking diode implemented as an active diode;

blocking leakage to the first voltage input from a regulated voltage output of the LDO regulator with the first blocking diode when the first voltage input is less than the regulated voltage output; and providing the regulated voltage output from the first voltage input and the second voltage input.

16. The method of claim 15, further comprising:

providing a second blocking diode implemented as an active diode; and blocking leakage to the second voltage input from the regulated voltage output with the second blocking diode when the second voltage input is less than the regulated voltage output.

17. The method of claim 15, further comprising providing the regulated voltage output to a plurality of internal devices of the LDO regulator.

18. The method of claim 15, further comprising:

providing a second blocking diode;

connecting a first control input of the first blocking diode to an anode of the second blocking diode; and connecting a second control input of the second blocking diode to an anode of the first blocking diode.

19. The method of claim 15, further comprising providing transistors to implement the first blocking diode.

20. The method of claim 15, further comprising:

providing a second blocking diode;

connecting the first voltage input to the first blocking diode through a first n-channel transistor;

connecting the second voltage input is connected to the second blocking diode through a second n-channel transistor; and operating the first and second n-channel transistors as voltage followers with respect to one another.

21. A method, comprising, in a low-drop-out (LDO) voltage regulator:

at a first voltage input, receiving input from a first voltage source;

at a second voltage input, receiving input from a second voltage source;

blocking leakage to the first voltage input from a regulated voltage output of the LDO regulator with the first blocking diode when the first voltage input is less than the regulated voltage output;

providing the regulated voltage output from the first voltage input and the second voltage input; and connecting an output tank within the LDO voltage regulator between the regulated voltage output and ground.

* * * * *